United States Patent [19]

Buchheister et al.

[11] Patent Number: 4,509,921

[45] Date of Patent: Apr. 9, 1985

[54] METHOD OF USING SKI TRAINING HALTER

[76] Inventors: Sue Buchheister, P.O. Box 80; Ann Poulson, P.O. Box 132, both of Fraser, Colo. 80442

[21] Appl. No.: 562,989

[22] Filed: Dec. 19, 1983

Related U.S. Application Data

[62] Division of Ser. No. 236,671, Feb. 20, 1981, Pat. No. 4,424,040.

[51] Int. Cl.[3] ..... G09B 19/00

[52] U.S. Cl. ..... 434/253

[58] Field of Search ..... 434/250, 252, 253, 254

[56] References Cited

U.S. PATENT DOCUMENTS

| | | | |
|---|---|---|---|
| 1,310,953 | 7/1919 | O'Connor | 119/96 |
| 1,749,999 | 3/1930 | Crocker . | |
| 2,212,746 | 8/1940 | Nunn | 227/49 |
| 2,956,541 | 10/1960 | Rall | 119/96 |
| 2,960,180 | 11/1960 | Wachtel | 182/3 |
| 2,979,028 | 4/1961 | Zakely | 119/96 |
| 2,984,497 | 5/1961 | Hagen | 280/11.35 |
| 3,088,438 | 5/1963 | Oliphant | 119/96 |
| 3,176,793 | 4/1965 | Hlacia | 182/3 |
| 3,322,102 | 5/1967 | Windle | 119/96 |
| 3,424,134 | 1/1969 | Rosenblum | 119/96 |
| 3,458,188 | 7/1969 | Infante | 272/1 |
| 4,197,816 | 4/1980 | Lusch | 119/96 |
| 4,303,041 | 12/1981 | Thompson et al. | 119/96 |
| 4,308,629 | 1/1982 | Freemon | 9/336 |

*Primary Examiner*—Harland S. Skogquist

*Attorney, Agent, or Firm*—Young & Martin

[57] ABSTRACT

A ski training halter is adapted for positioning on a person below his or her waist and to extend across the person's front, lower abdominal region to the respective left and right hip regions of the student's body. The training halter also includes portions adapted to be positioned around the upper portions of the student's thighs and interconnected with the portions extending across the student's lower abdominal and hip regions. Adjustable and detachable fasteners are provided to maintain the training halter in proper, taut position on the person's body, and elongated reins are detachably connected to the training halter and extended to a location rearwardly of the person where another person can be positioned safely on skis to hold the reins and use them to exert restraining and turning forces on the training halter.

1 Claim, 14 Drawing Figures

METHOD OF USING SKI TRAINING HALTER

BACKGROUND OF THE INVENTION

This patent application is a divisional application of the pending U.S. patent application, Ser. No. 236,671, filed Feb. 20, 1981 now U.S. Pat. No. 4,424,040.

This invention relates generally to a method and apparatus for teaching a learner to ski, and more specifically, to a method and apparatus for a ski instructor to restrain and control the movements of a student skier's body.

The preferred method of controlling speed, turning, and stopping for a person moving downhill on skis is for the person to use the technique of parallel turns and stops, as opposed to snow plow turns and stops. However, most ski instructors and beginning ski students find that it is a difficult task for a person to learn the technique of parallel turns and stops initially. There are several reasons for the difficulty in learning this technique, including the fact that a skier has to be moving at least at a certain minimum velocity before the parallel turn and stop technique can be used successfully, and that minimum required velocity is usually faster than the beginning skiers feel comfortable or secure in moving. Further, the parallel turn and stop technique requires the skier to twist or rotate his or her hips about one thigh or the other accompanied by a certain degree of weight shifting from one leg to the other. Since beginning skiers are usually quite unstable on skis and have no feel for parallel turns and stops, these hip rotating and weight shifting movements are perceived to be significantly more drastic than their confidence and control will allow. The snow plow technique, however, requires very little shifting of weight or rotation of hips, and snow plow stopping at low speeds on gentle slopes can be accomplished easily by most beginning skiers. Consequently, it is easier for most students to assume a snow plow position in which they can more easily move and stop in low enough velocity ranges wherein their confidence in their abilities to control themselves are maintained more easily.

This problem of maintaining adequate control is compounded to some extent for relatively small children who are learning to ski, at least initially, since they usually lack the muscle control and strength in their legs and hips to even use the snow plow technique to control their movement and velocity.

Many methods have been and are still being tried for teaching students the parallel technique for skiing, but they all have problems. Most of these problems result from the common psychological inability of the student to acquire and maintain the required confidence to perform the hip rotating and weight shifting motions required by the parallel skiing technique due primarily to the natural fear of falling. The inventors are familiar with some of the methods used commonly by some ski instructors to restrain the movement or velocity of the students. For example, it is quite common to restrain the motion of a student physically by use of a strap or rope wrapped around the student's waist and extending rearwardly to a position where the strap or rope can be held by the instructor. Another method observed by the inventors, primarily for use on small children, includes the use of a harness or halter around the student's upper torso or chest and shoulders with a strap or rope extending from the harness or halter rearwardly to a position where it can be held by the instructor.

These methods are effective to restrain the forward velocity of the student, but they are ineffective to assist the student in his or her efforts to attempt the weight shift and hip rotation movements necessary to use the parallel technique of skiing. In fact, it has been found that such restraint methods actually inhibit the student's efforts to use these parallel skiing techniques. For example, one of the major disadvantages of these restraint methods is that the restraint force exerted by the instructor on the student's waist or upper torso region tends to pull the student, who is usually already unstable, further off balance. Further, the restraint forces applied on the student's body by these methods tend to act in opposition to the motions necessary to accomplish the hip rotating and weight shifting motions required for the parallel skiing technique.

Consequently, until the development of this invention, a need has always existed and had not yet been met for a method and apparatus that would allow a ski instructor to physically restrain and control the movements of beginning ski students that would not tend to throw the student off balance or inhibit the student's attempts to apply the parallel skiing techniques and which would actually apply forces in the proper directions and on the proper portions of the student's body to actually enhance the student's attempts to utilize the hip rotating and weight shifting movements of the parallel skiing technique.

SUMMARY OF THE INVENTION

Accordingly, it is an object of the present invention to provide a novel ski training halter for restraining and controlling the movements of a beginning ski student in a manner which assists the student in making the required weight shifting and hip rotating movements for learning and using the parallel ski technique and thereby to enhance and maintain the confidence of the student to the point where the parallel ski technique can be learned relatively quickly and safely without fear by the student.

Another object of the present invention is to provide a method and apparatus for an instructor to apply rearwardly directed restraining forces on a ski student's lower abdominal and hip regions to control forward velocity of the student and to rotate the student's hips to pivot about a selected one of the student's thighs in such a manner as to cause the pivot thigh to be forward of the other thigh to utilize the natural, instinctive tendency of a person in an unstable condition to shift his or her weight to the forward leg in teaching the required hip rotation and weight shifting movements necessary for the parallel skiing techniques.

It is also an object of the present invention to provide a ski training halter for restraining and controlling the movements of a beginning ski student that is relatively uncomplicated, easy to mount on the student, and safe for the student to wear on the ski slope.

The ski training halter of the present invention includes an apparatus adapted to be positioned across the front, lower abdominal region of a person's body below his or her waist region and a pair of straps or reins, each of which is adapted to attach to the apparatus for the instructor to apply appropriate forces to the student's hip regions and lower abdominal regions to restrain and control the movement of the person while moving on a ski slope.

The apparatus includes two looped members, each of which is adapted to be positioned around the upper rear portions of opposite ones of the person's thighs and to extend across the lower abdominal portion of the person's body to opposite hip regions of the person. Straps also extend from the looped members adjacent the opposite hip regions around the person's back where they can be attached together to maintain the apparatus in proper position on the person's lower abdominal and left and right hip regions. The reins are attached to the respective looped members at the left and right hip regions and extend rearwardly to a distance necessary for a ski instructor positioned a safe distance behind the person to hold and exert restraining and turning forces on the person's hips and upper thighs. These forces when properly applied to the lower abdominal and hip regions of a person on skis are effective to control the velocity of the person's forward motion, as well as to firmly guide and assist the person in making the required hip rotating and weight shifting motions necessary to perform the parallel skiing techniques successfully. The looped members include novel configurations and novel adjustment features to readily and easily accommodate different sized students. The reins are readily detachable from the training halter for purposes of safety and convenience when the training halter is not being used.

BRIEF DESCRIPTION OF THE DRAWINGS

Other objects, advantages, and capabilities of the present invention will become apparent as the description proceeds taken in conjunction with the accompanying drawings, in which.

DETAILED DESCRIPTION OF THE PREFERRED EMBODIMENT

Figure 1:
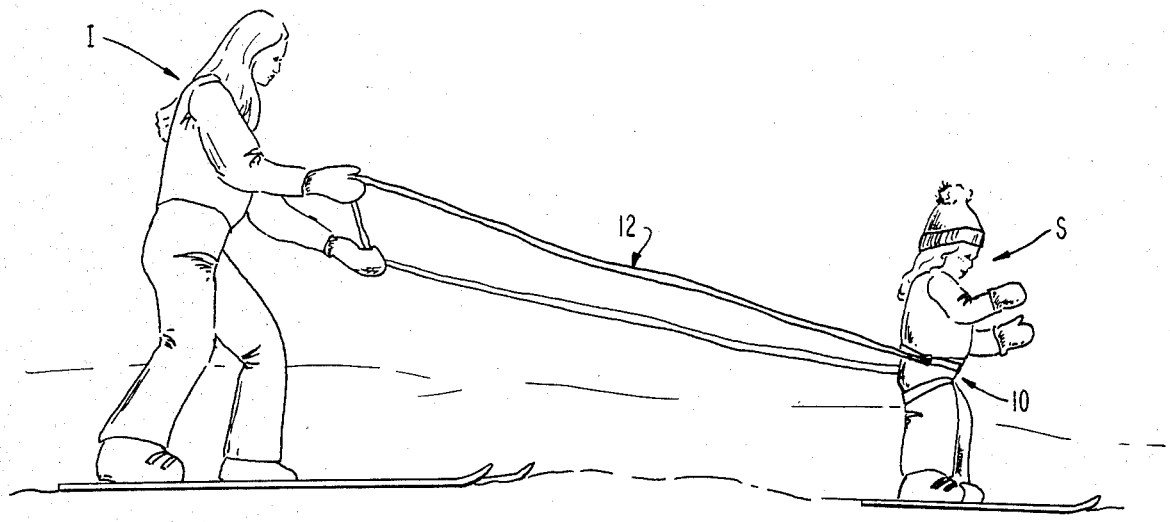
FIG. 1 is a perspective view of the ski training halter of the present invention mounted on a child ski student and being used by an instructor.
Figure 2:
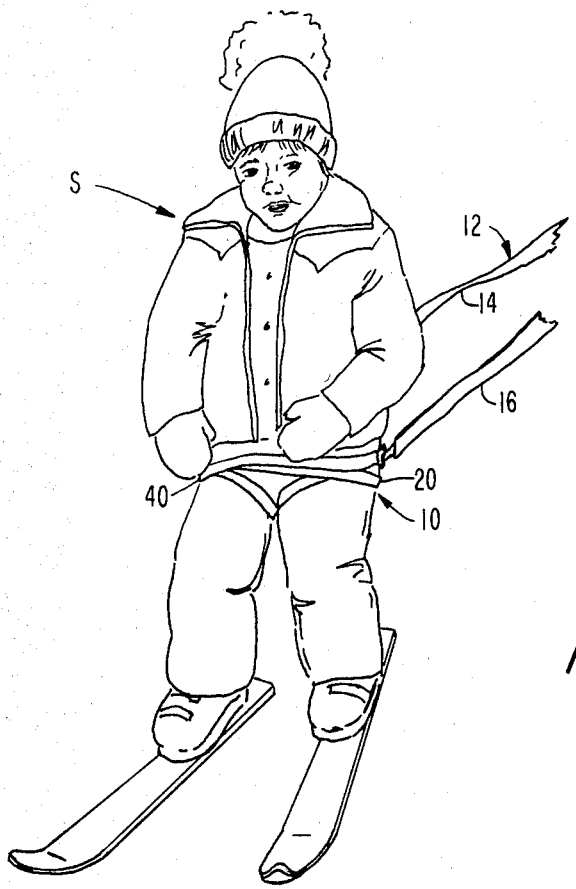
FIG. 2 is a front perspective view of the ski training halter of the present invention mounted on a child ski student.

A ski training halter 10 in accordance with the present invention is shown in FIGS. 1–4 as it is intended to be used in the method of training student skiers. In FIG. 1, a child ski student S is shown with the ski training halter 10 mounted around the student's thighs, lower abdominal region and left and right hip regions. A ski instructor I is located a spaced distance behind the student S and is shown holding or gripping the reins 12, which are attached to the ski training halter 10 at locations adjacent the opposite hip regions of the student S. In FIG. 2, the ski student S is shown from the front with the ski training halter 10, which is comprised of two looped members 20, 40, positioned around the thighs, lower abdominal region and left and right hip region of the student S. Respective right and left ends 14, 16, of reins 12 are shown attached to the respective looped members 20, 40, adjacent the respective right and left hip regions of the student's body and extending rearwardly from the student.

Figure 3:
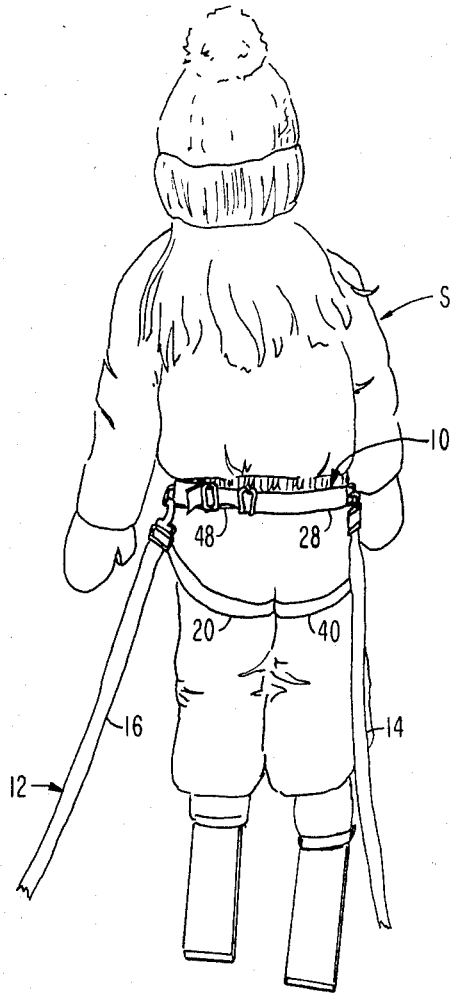
FIG. 3 is a rear perspective view of the ski training halter of the present invention mounted on a child ski student.

In FIG. 3, the ski student S, is shown from the back, again with the respective looped members 20, 40, of the ski training halter 10 positioned around the student's thighs and hips with fastener portions 28, 48, of the looped member members 20, 40, respectively, shown fastened together around the student's back. The specific structure and preferred position of mounting the ski training halter 10 of the present invention on the student will be described in more detail below.

Figure 4:
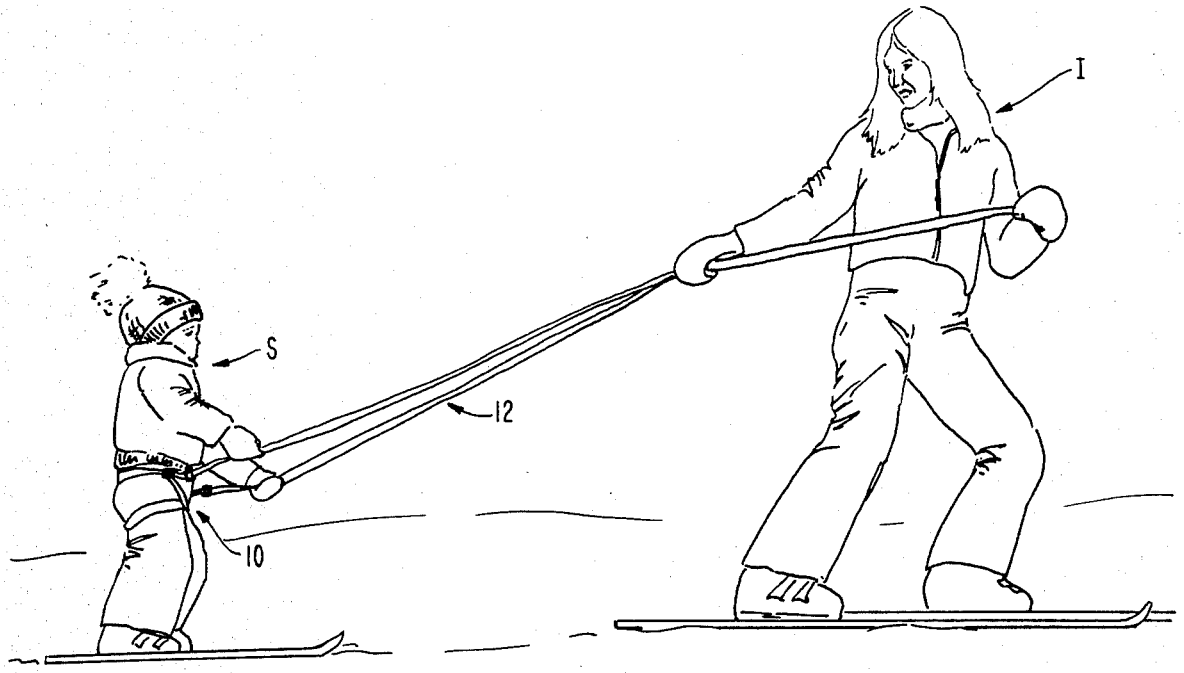
FIG. 4 is a perspective view showing another use for the ski training halter of the present invention to pull a student over relatively flat terrain.
Figure 5:
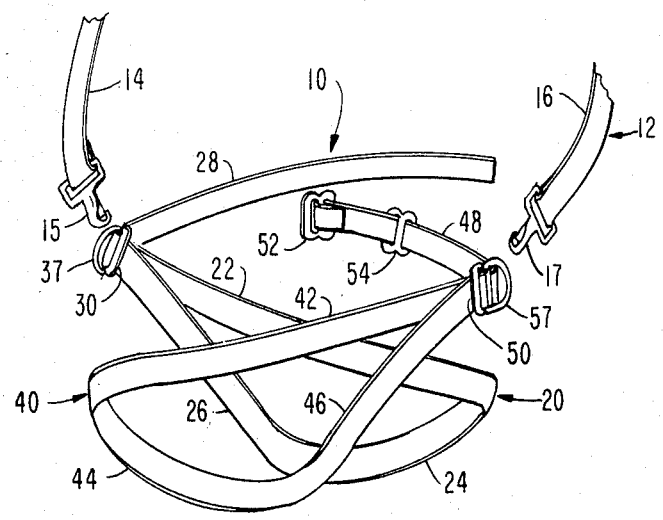
FIG. 5 is a front elevation view of the ski training halter of the present invention.

An additional advantage of the ski training halter 10 and accompanying reins 12 of the present invention, particularly for training small children who find it difficult to move on skis across flat terrain or up gentle hills, is shown in FIG. 4. The reins 12 can be attached to the ski training halter 10 and extended to the front of the student S, in which position the instructor I can pull the student over flat terrain or up gently sloping hills in order to move the student more efficiently from one point to another when the benefit of a downward graded slope is not available.

A more detailed description of the structure of the preferred embodiment of the ski training halter 10 of the present invention and its proper positioning or mounting on a student S for its most effective use in training a beginning skier is shown in FIGS. 5–8. The ski training halter 10 is comprised of two looped members 20, 40, preferably fabricated from flexible straps. Each looped member 20, 40, respectively, has an upper front portion 22, 42, a rear portion, 24, 44, a lower front portion 26, 46, and a fastener portion 28, 48.

The rear portion 24 of looped member 20 is adapted to be positioned around the left side and rear of the upper portion of the student's left thigh just under the student's left buttock, and also to extend forwardly through the student's crotch. The upper front portion 22 of looped member 20 is adapted to extend from the left side of the student's left thigh upwardly and across the front, lower abdominal region to the student's right hip region. The lower front portion 26 of looped member 20 is adapted to extend from the student's crotch upwardly from the groin area across the right portion of the lower abdominal region to the student's right hip region where the upper front portion 22 and lower front portion 26 are slidably connected together by a double ringed slide fastener 30 as will be described in more detail below. The fastener portion 28 of looped member 20 extends from the lower front portion 26 adjacent the student's right hip region around the back of the student just over the student's buttocks. A D-ring connector 37 is also attached to the looped portion 20 at the point of connection between upper front portion 22 and lower front portion 26, and a snap type fastener 15 affixed to the end 14 of rein 12. The snap fastener 15 is adapted to be releasably attached to the D-ring 37 adjacent the student's right hip region.

Figure 8:
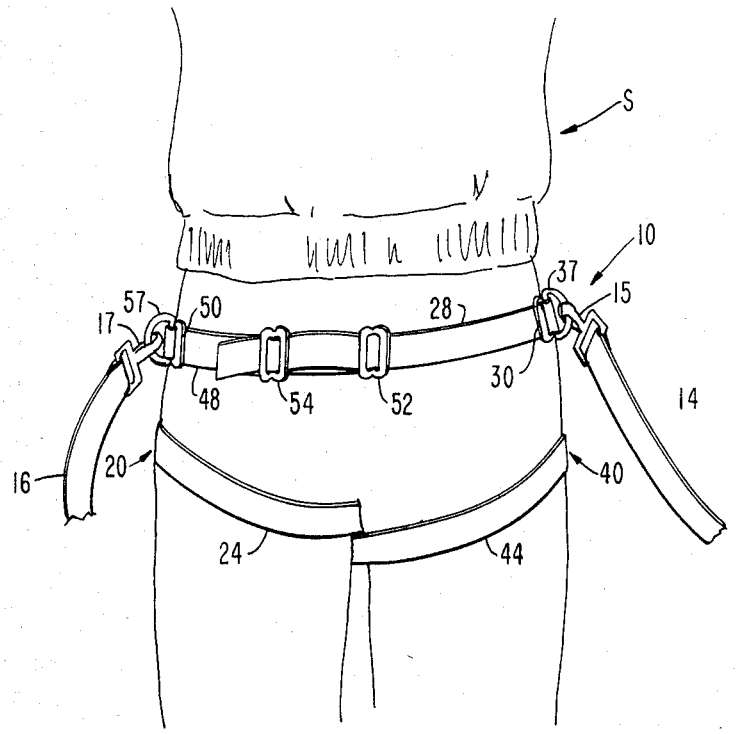
FIG. 8 is a rear elevation view of the ski training halter of the present invention shown properly mounted on a ski student according to the present invention.

The second looped member 40 is similar in construction to the looped member 20. Looped member 40 also includes a rear portion 44 adapted to be positioned around the right side and rear of the upper portion of the student's right thigh just under the student's right buttock, and also to extend forwardly through the student's crotch. The upper front portion 42 of looped member 40 is adapted to extend from the right side of the student's thigh upwardly and across the student's front lower abdominal region to the student's left hip region. The lower front portion 46 of looped member 40 extends from the student's crotch and upwardly from the groin region over the left portion of the front, lower abdominal region to the student's left hip region. The upper front portion 42 and lower front portion 46 are adjustably connected together adjacent the student's left hip region by double ring slide fastener 50. Fastener portion 48 of looped member 40 extends from lower front portion 46 adjacent the student's left hip portion around the student's back just over the buttocks. As best seen in FIG. 8, fastener portion 28 of looped member 20 and fastener portion 48 of looped member 40 are adjustably attached together just over the student's buttocks by a pair of double ring slide fasteners 52, 54, which will be described in more detail below. A second snap ring 17 is mounted on the end 16 of rein 12 and is adapted for releasable attachment to D-ring 57 adjacent the student's left hip region.

Figure 11:
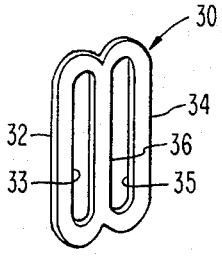
FIG. 11 is a perspective view of a double ringed slide fastener that is typical of those used in the construction of the present invention.
Figure 9:
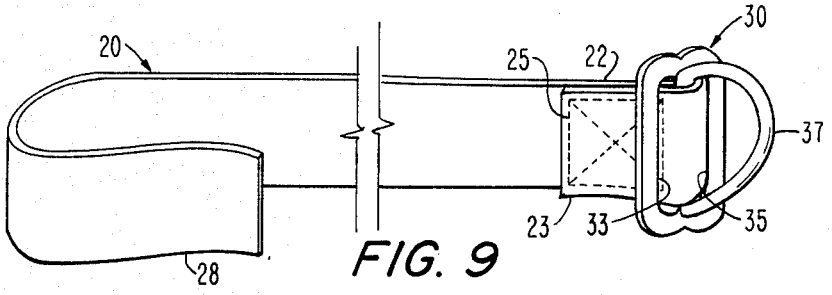
FIG. 9 is a perspective view of one of the looped members of the ski training halter showing the construction thereof.
Figure 12:
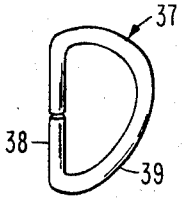
FIG. 12 is a perspective view of a D-ring connector that is typical of those used in the construction of the present invention.
Figure 10:
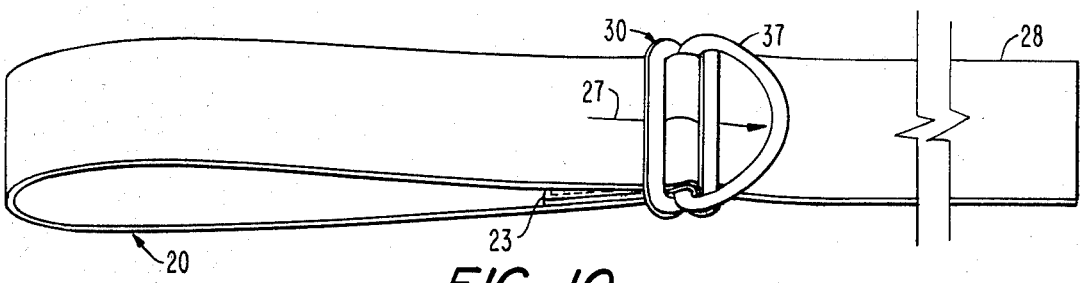
FIG. 10 is a perspective view of one of the looped members of the ski training halter as properly assembled.

The construction of looped member 20 is best seen by reference to FIGS. 9 and 10. The connection and fastener features of the present invention utilize conventional double ring slide fasteners, of which the fastener 30 in FIG. 11 is typical, and conventional D-ring connectors of which D-ring connector 37 in FIG. 12 is typical. As shown in FIG. 11, the double ring slide fastener 30 is formed with two adjacent rings 32, 34, which have a common center section 36. An opening 33 is formed between ring portion 32 and center section 36, and a second opening 35 is formed between ring portion 34 and center section 36. The D-ring 37, as shown in FIG. 12, is comprised of a straight portion 38 with a curved portion 39 extending from both ends of straight portion 38.

Referring again to FIG. 9, looped member 20 is constructed by placing D-ring 37 adjacent slide fastener 30, with the straight portion 38 of D-ring 37 placed against the center section 36 of slide fastener 30. The end 33 of looped member 20, which is the end of upper front portion 22, is inserted through opening 35 of slide fastener 30, through D-ring 37 around its straight portion 38, and back through opening 33 in slide fastener 30. The end 23 is then laid against an adjacent portion of upper front portion 22 and permanently fastened in that position, preferably by sewing as indicated by the stitching 25. The fastener portion 28 of looped member 20 is then doubled back as shown in FIG. 10 and inserted through openings 33, 35 in slide fastener 30 over end 23, as indicated by arrow 27 in FIG. 10. In this manner, the size of looped member 20 can be adjusted to accommodate various sized persons and to position the D-ring fastener 37 at the optimum position adjacent the person's hip region.

Figure 13:
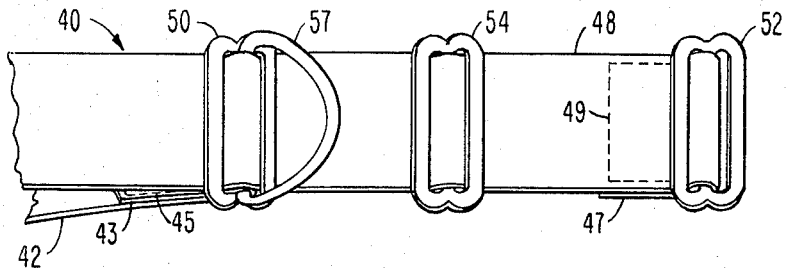
FIG. 13 is a perspective view of the other looped member of the ski training halter of the present invention as properly assembled.

As shown in FIG. 13, looped member 40 is constructed similar to looped member 20. The end 43 of upper front portion 42 is inserted through the slots in slide fastener 50 and through D-ring connector 57. The end 43 is then returned on itself and sewn in that position, as indicated by the stitching 45. The fastener portion 48 is then returned and inserted through slide fastener 50 and D-ring connector 57 over the end 43 to form the looped member 40. In addition, the fastener portion 48 of looped member 40 also includes a slide fastener 54 positioned to slide freely thereon and another slide fastener 52 permanently attached in place by end 47 inserted through the respective openings in slide fastener 52 and permanently attached to itself, preferably by sewing as indicated by the stitching 49.

The ski training halter 10 can be put on a ski student S easily. First, the student S inserts his or her left foot through looped member 20, then the student S inserts his or her right foot through looped member 40. Looped member 20 is pulled up the left leg until rear portion 24 is positioned just under the left buttock with the upper and lower front portions 22, 26 extended in front of the student's body. The upper and lower front portions 22, 26 are then pulled across the student's lower abdomen to his or her right hip. The D-ring connector 37 should be positioned preferably adjacent the right hip with the fastener portion 28 extending around the student's back. If the D-ring connector 37 is not positioned at the student's right hip when the upper and lower front portions 22, 26 are pulled taut over the lower abdominal region, the size of the looped member 20 can be adjusted with slide fastener 30.

Looped member 40 is then pulled up the right leg until rear portion 44 is positioned just under the right buttock with the upper and lower front portions 42, 26 extended in front of the student's body. The upper and lower front portions 42, 46 are then pulled across the student's lower abdomen to his or her left hip. The D-ring connector 57 should be positioned preferably adjacent the student's left hip with the fastener portion 48 extending around his or her back. If the D-ring connector 57 is not positioned at the student's left hip when the upper and lower front portions 42, 46 are pulled taut over the lower abdominal region, the size of the looped member 40 can be adjusted with slide fastener 50.

Figure 6:
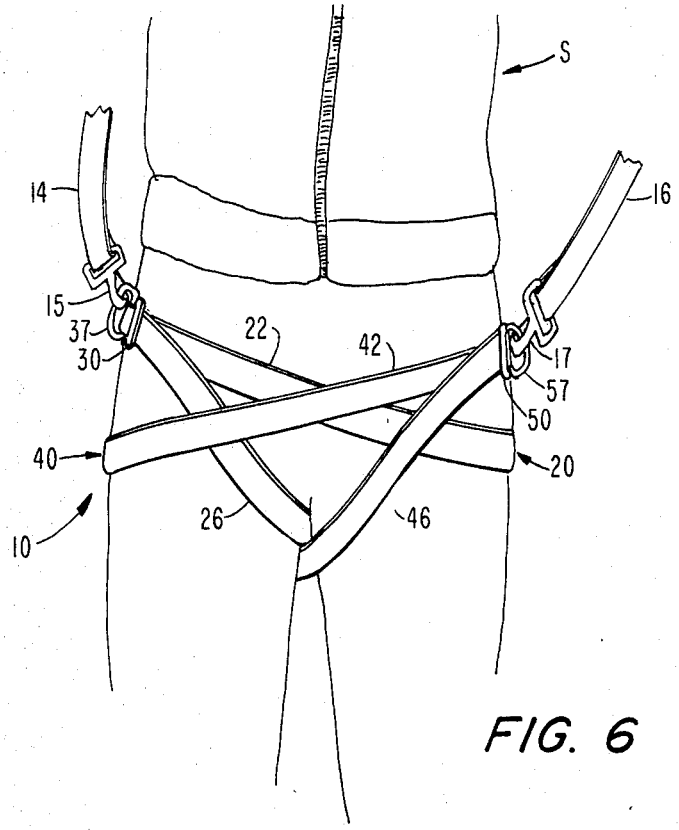
FIG. 6 is a front elevation view of the ski training halter of the present invention properly mounted on a ski student in accordance with the present invention.
Figure 7:
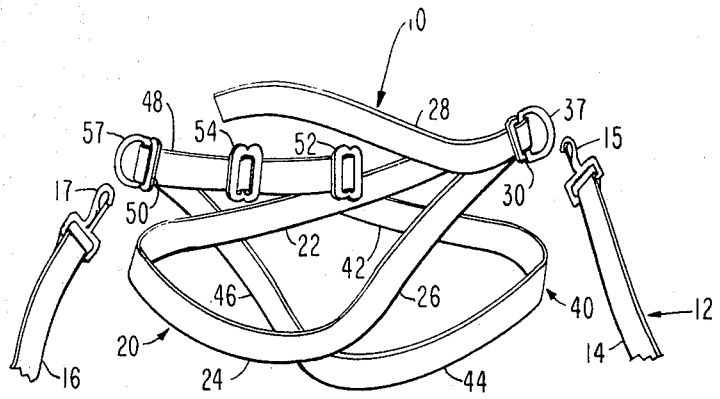
FIG. 7 is a rear elevation view of the ski training halter of the present invention.

When the ski training halter 10 of the present invention is properly mounted on a student, as shown in FIGS. 6 and 8 according to the description above, the two looped portions 20, 40 are fastened together as best seen in FIG. 8 to retain the ski training halter 10 in the proper taut position on the student S. The end of fastener portion 28 is inserted through the respective openings in slide fastener 52 on fastener portion 48 until the fastener portions 28, 48 and the looped members 20, 40 are taut against the student's body. This fastener portion 52 is the primary fastener for holding the respective fastener portions 28, 48 of looped portions 20, 40 together to retain the ski training halter 10 in proper position on the student. Since an additional length of fastener portion 28 is preferably provided to accommodate different sized ski students, the free or dangling end of fastener portion 28 can be advantageously passed through the respective openings of slide fastener 54 as shown in FIG. 8 to keep it from flapping or becoming entangled in ski clothing, ski apparatus or ski lift devices. Since the slide fastener 54 can be slid freely along the length the fastener portion 48 between slide ring 50 and slide ring 52, it can be adjusted at an optimum position along that length for holding down the free end of fastener portion 28.

Figure 14:
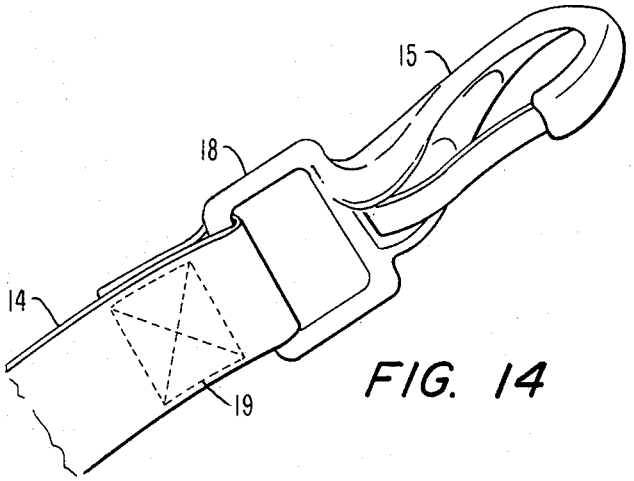
FIG. 14 is a perspective view of the releasable attachment hook on one end of a rein of the present invention.

As mentioned above, common snap ring fasteners 15, 17 are fastened on the respective ends 14, 16 of reins 12. A typical snap ring fastener 15 is shown in FIG. 14 attached to the end 14 of rein 12. The end 14 of the rein 12 is passed through the ringed opening 18 of snap ring fastener 15 and returned and attached onto itself, preferably by sewing as indicated by stitching 19. The ends 14, 16 of reins 12 are shown in FIGS. 6 and 8 with the respective snap rings fasteners 15, 17 attached to respective D-ring connectors 37, 57. The reins 12 can be detached from the halter 10 when the students use lift devices to minimize risk of injury or other mishaps due to possible entanglement of the reins in such devices.

In the preferred manner of using the ski training halter 10 of the present invention in training beginning skiers, the instructor I positions himself or herself a spaced distance behind the student S, as shown in FIG. 1. The respective ends 14, 16 of reins 12 are attached to opposite sides of the halter 10 at the student's left and right hip regions, as shown in FIGS. 6 and 8. The instructor I can allow the student S to begin moving slowly down the ski slope, preferably with the student's skis parallel to each other and with the student in a slightly crouched position with knees bent and leaning slightly forward at the waist, as in the preferable parallel skiing form. For better control at slow speed, the instructor can assume the snow plow position during the training session.

If the student begins to move too fast down the slope, the instructor can pull back evenly on the reins 12. The ski training halter 10 is effective to apply such a restraining force evenly across the skier's lower abdominal and left and right hip regions to slow the velocity of the student and to maintain the student's speed in an acceptable range where the student is not unduly frightened. The ski training halter 10 of this invention is unique in this regard, because the restraining forces exerted on the lower abdominal and hip regions of the student do not pull the student off balance. The skier's centers of control are located in the hips and upper thigh regions and the upper portions of a skier's body are used for balance purposes. While being restrained by the ski training halter 10 of the present invention in the lower abdominal and hip regions, the student can still bend forward or backward in the waist and upper torso and move his or her arms and shoulders to the extent necessary to maintain balance without any inhibition from external restraining forces exerted by the instructor.

When the instructor I desires the student to shift into a parallel turn, the instructor can exert an additional increment of force on either of the student's left or right hip regions, depending on the direction the instructor wants the student to turn. For example, if the instructor wants the student to turn to the right, the instructor can exert an additional rearwardly directed force increment on the right end 14 of rein 12. This additional force increment tends to pull the student's right hip rearwardly as the force is evenly applied to the student's right hip and right lower abdominal regions by the upper and lower front portions 22, 26 of looped member 20.

The ski training halter 10 of the present invention also assists the student to more firmly and confidently shift his or her weight to the left ski, which is also necessary for a proper parallel turn. The rear portion 24 of looped member 20 further enhances the tendency of this force exerted by the instructor to cause these rotating and weight shifting movements by using the student's left thigh as a pivot for the rotation. It tends to pull the left leg forward in relation to the right hip while the right hip and right leg tend to rotate rearwardly. This tendency of the ski training halter 10 to rotate the hips about the left leg in such a manner that the left leg tends to be extended forwardly of the right hip and right leg causes the student to instinctively shift more weight to the left leg, since it is natural for a person attempting to regain some stability to put the weight of his or her body on the forward leg. Of course, this shifting of the weight to the forward or left leg, in combination with the rotation of the hips to the right, causes the student to also rotate the skis to the turning edges, which movements constitute the basis for making a parallel turn in proper form. Of course a left turn is accomplished in a similar manner and with equal effectiveness as a right turn when the instructor exerts an additional increment of force on the left rein.

It can be appreciated therefore that the steady restraining force applied by the instructor to the student's lower abdominal and hip regions to control the velocity of the skier down the slope tends to keep the student feeling secure and to maintain the student's confidence. Further, the ability of the instructor to gently but firmly rotate the student's hips to pivot about the student's legs to cause the natural shifting of the student's weight to the turning ski allows the student to quickly experience the feel of parallel turns under stable, secure conditions. Therefore, this method also enhances the student's confidence in his or her ability to accomplish such a turn and increases the effectiveness of the instructor's efforts in a shorter period of time. Of course, the instructor can assert more or less control and allow the student more or less freedom as the instructor deems necessary or desirable as the student's confidence and ability develops.

Although the present invention has been described with a certain degree of particularity, it is understood that the present disclosure has been made by way of example and that changes in details and structure may be made without departing from the spirit thereof.

We claim:

1. The method of restraining and controlling one skier on one set of skis by a second skier on a separate set of skis, comprising the steps of:

positioning the second skier behind the first skier a sufficient distance such that the respective first and second skier's skis cannot contact each other;

extending one elongated flexible member from the second skier to the first skier's right hip and across the first skier's front abdomen to the first skier's left thigh and anchoring it there;

extending another elongated flexible member from the second skier to the first skier's left hip and across the first skier's front abdomen to the first skier's right thigh and anchoring it there;

applying rearward forces on both of said flexible members equally to restrain the first skier's forward motion;

applying a greater rearward force on the right flexible member than the left flexible member to induce the first skier to turn right; and applying a greater rearward force on the left flexible member than the right flexible member to induce the first skier to turn left.

* * * * *